US010782018B2

(12) United States Patent
Cadima

(10) Patent No.: US 10,782,018 B2
(45) Date of Patent: Sep. 22, 2020

(54) BOOSTED GAS BURNER ASSEMBLY WITH OPERATING TIME AND FUEL TYPE COMPENSATION

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 41 days.

(21) Appl. No.: 16/260,234

(22) Filed: Jan. 29, 2019

(65) Prior Publication Data

US 2020/0240630 A1 Jul. 30, 2020

(51) Int. Cl.

| | |
|---|---|
| ***F23D 14/60*** | (2006.01) |
| ***F23N 1/02*** | (2006.01) |
| ***F24C 3/12*** | (2006.01) |
| ***F23N 5/00*** | (2006.01) |

(52) U.S. Cl.

CPC ..... *F23D 14/60* (2013.01); *F23N 1/022* (2013.01); *F23N 5/003* (2013.01); *F24C 3/126* (2013.01); *F23D 2208/00* (2013.01); *F23N 2225/16* (2020.01); *F23N 2233/06* (2020.01)

(58) Field of Classification Search

CPC ..... F23N 5/20; F23N 5/203; F23N 2227/02

See application file for complete search history.

(56) References Cited

U.S. PATENT DOCUMENTS

| | | | | |
|---|---|---|---|---|
| 5,971,745 | A * | 10/1999 | Bassett | F23N 1/022 431/12 |
| 6,076,517 | A * | 6/2000 | Kahlke | F24C 3/047 126/39 J |
| 8,479,721 | B2 * | 7/2013 | Graham | F23D 14/105 126/1 R |
| 2004/0048212 | A1 * | 3/2004 | Honda | F23N 5/242 431/24 |
| 2006/0078836 | A1 * | 4/2006 | Kim | F23N 3/002 431/12 |
| 2014/0199641 | A1 * | 7/2014 | Chian | F23Q 7/26 431/6 |
| 2015/0159887 | A1 * | 6/2015 | Kadah | F27B 9/40 700/276 |
| 2017/0003024 | A1 * | 1/2017 | Vendramini | F23N 5/203 |
| 2017/0219209 | A1 * | 8/2017 | Suzuki | F23N 5/265 |

FOREIGN PATENT DOCUMENTS

JP 4565203 B2 10/2010

* cited by examiner

*Primary Examiner* — David J Laux

(74) *Attorney, Agent, or Firm* — Dority & Manning, P.A.

(57) ABSTRACT

A gas burner assembly and a method of operating the same are provided. The gas burner assembly includes fuel valve for providing a flow of fuel and an air pump for providing a flow of air into a boost fuel chamber prior to combustion. The method includes obtaining a predetermined cold start airflow schedule and modifying the cold start airflow schedule if the operating history of the gas burner assembly indicates that the temperature of the gas burner assembly is elevated, e.g., not cold. Specifically, the warmer the gas burner assembly, the more the airflow is increased relative to the cold start airflow schedule.

20 Claims, 12 Drawing Sheets

BOOSTED GAS BURNER ASSEMBLY WITH OPERATING TIME AND FUEL TYPE COMPENSATION

FIELD OF THE INVENTION

The present subject matter relates generally to gas burners, and more particularly to forced air gas burners for providing fuel/air ratios for improved combustion.

BACKGROUND OF THE INVENTION

Conventional gas cooking appliances have one or more gas burners, e.g., positioned at a cooktop surface for use in heating or cooking an object, such as a cooking utensil and its contents. These gas burners typically combust a mixture of gaseous fuel and air to generate heat for cooking. Known burners frequently include an orifice, a Venturi mixing throat, and a plurality of flame ports. The orifice ejects a jet of gaseous fuel which entrains air while passing through the Venturi mixing throat. The air and gaseous fuel mix within the Venturi mixing throat before the mixture is combusted at the flame ports of the burners. Such burners are generally referred to as naturally aspirated gas burners.

Naturally aspirated gas burners can efficiently burn gaseous fuel. However, a power output of naturally aspirated gas burners is limited by the ability to entrain a suitable volume of air into the Venturi mixing throat with the jet of gaseous fuel. Moreover, there is a trend in the cooking appliance market toward high-powered burners in order to speed up cooking tasks. Thus, to provide increased entrainment of air, certain gas burners include a fan or air pump that supplies pressurized air for mixing with the jet of gaseous fuel. Such gas burners are generally referred to as forced air gas burners.

While offering increased power, known forced air gas burners suffer from various drawbacks. For example, gas burners heat up as they operate, which results in a reduction of air entrainment into the mixing throat. More specifically, the entrained air is preheated as it passes along and over hot burner surfaces resulting in an air density reduction. Gas burners may compensate for this phenomenon by providing excess air at cold start in order to end up with an ideal air entrainment at the hot state, but excess air causes flame instability and potentially excessive noise. Alternatively, the gas burner may be designed with ideal cold start fuel/air ratios and accept the drawbacks of reduced air entrainment at steady state, but this approach results in longer, lazier flames, which are also undesirable.

Another challenge for gas burner design is ensuring compatibility with different fuels, namely propane and natural gas fuels commonly used in household cooking. In this regard, the manufacturer may preset the desired airflow for compatibility with a specific fuel. If a boosted burner is converted to another fuel by the installer, the preset airflow may result in inefficient combustion or poor burner performance. Alternatively, the manufacturer may set the airflow in a range compatible with both fuels, but this may result in less than optimum burner performance regardless of the fuel type used.

Accordingly, a cooktop appliance including a boosted burner that could start up cold with airflow set to provide quiet flames and compensate for air density losses as the burner heats up would be desirable. More specifically, a gas burner assembly that offers the ability to prescribe the airflow to the burner based on the fuel type being used would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a method of operating a gas burner assembly is provided. The gas burner assembly includes a boost burner, a fuel regulating device for providing a flow of fuel to the boost burner, and an air pump for providing a flow of air to the boost burner. The method includes opening the fuel regulating device to provide the flow of fuel to the boost burner, obtaining a predetermined cold start airflow schedule, and obtaining an operating history of the gas burner assembly. The method further includes determining an adjusted airflow schedule based at least in part on the cold start airflow schedule and the operating history of the gas burner assembly and operating the air pump to provide the flow of air according to the adjusted airflow schedule.

In a second example embodiment, a gas burner assembly for a cooktop appliance is provided. The gas burner assembly includes a boost burner including a plurality of boost flame ports in fluid communication with a boost fuel chamber. A fuel regulating device is fluidly coupled to the boost fuel chamber for providing a flow of fuel to the boost fuel chamber and an air pump selectively urges a flow of air into the boost fuel chamber. A controller is operably coupled to the fuel regulating device and the air pump for opening the fuel regulating device to provide the flow of fuel to the boost fuel chamber, obtaining a predetermined cold start airflow schedule, and obtaining an operating history of the gas burner assembly. The controller is further configured for determining an adjusted airflow schedule based at least in part on the cold start airflow schedule and the operating history of the gas burner assembly and operating the air pump to provide the flow of air according to the adjusted airflow schedule.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
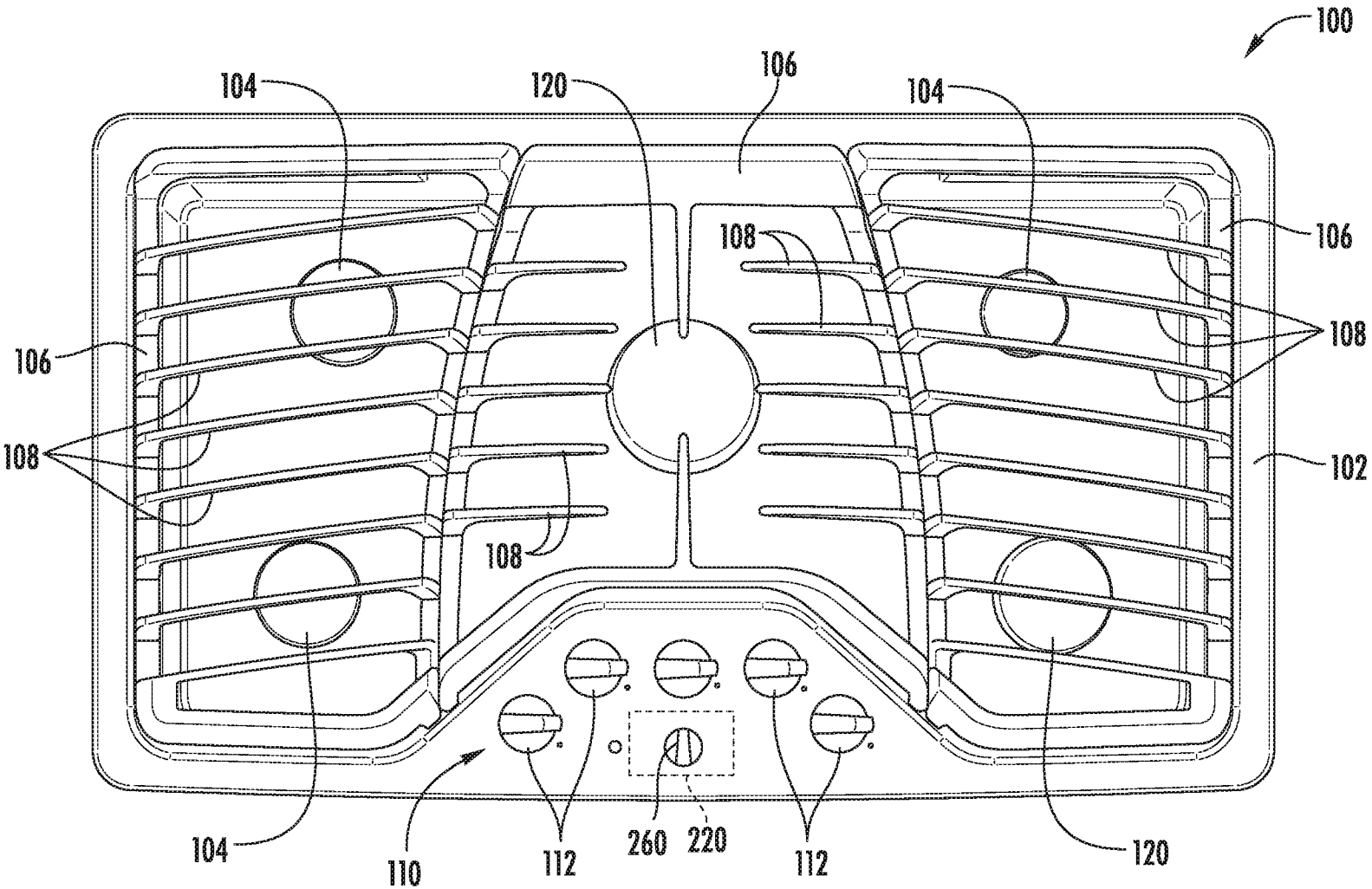
FIG. 1 provides a top, plan view of a cooktop appliance according to an example embodiment of the present disclosure.
Figure 2:
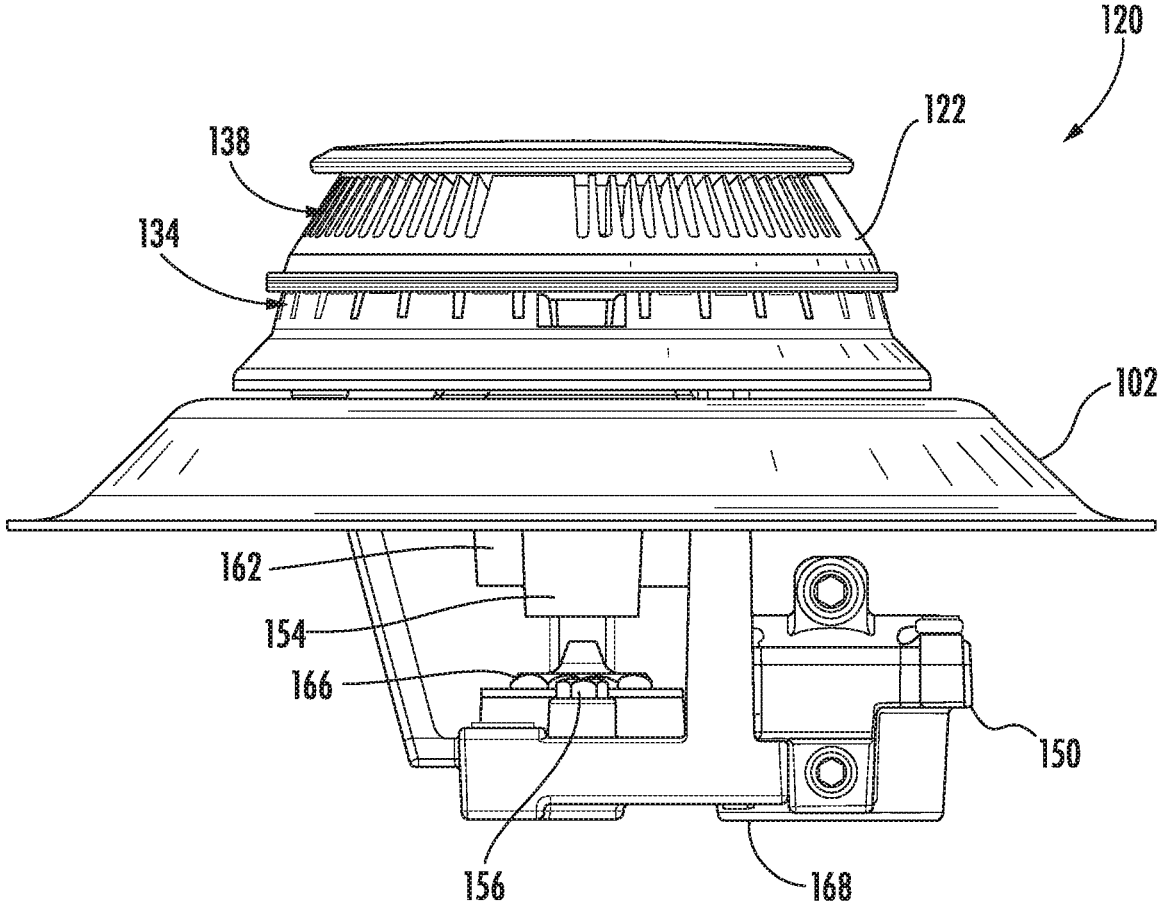
FIG. 2 is a side elevation view of a gas burner assembly that may be used with the exemplary cooktop appliance of FIG. 1 according to an exemplary embodiment of the present subject matter.
Figure 3:
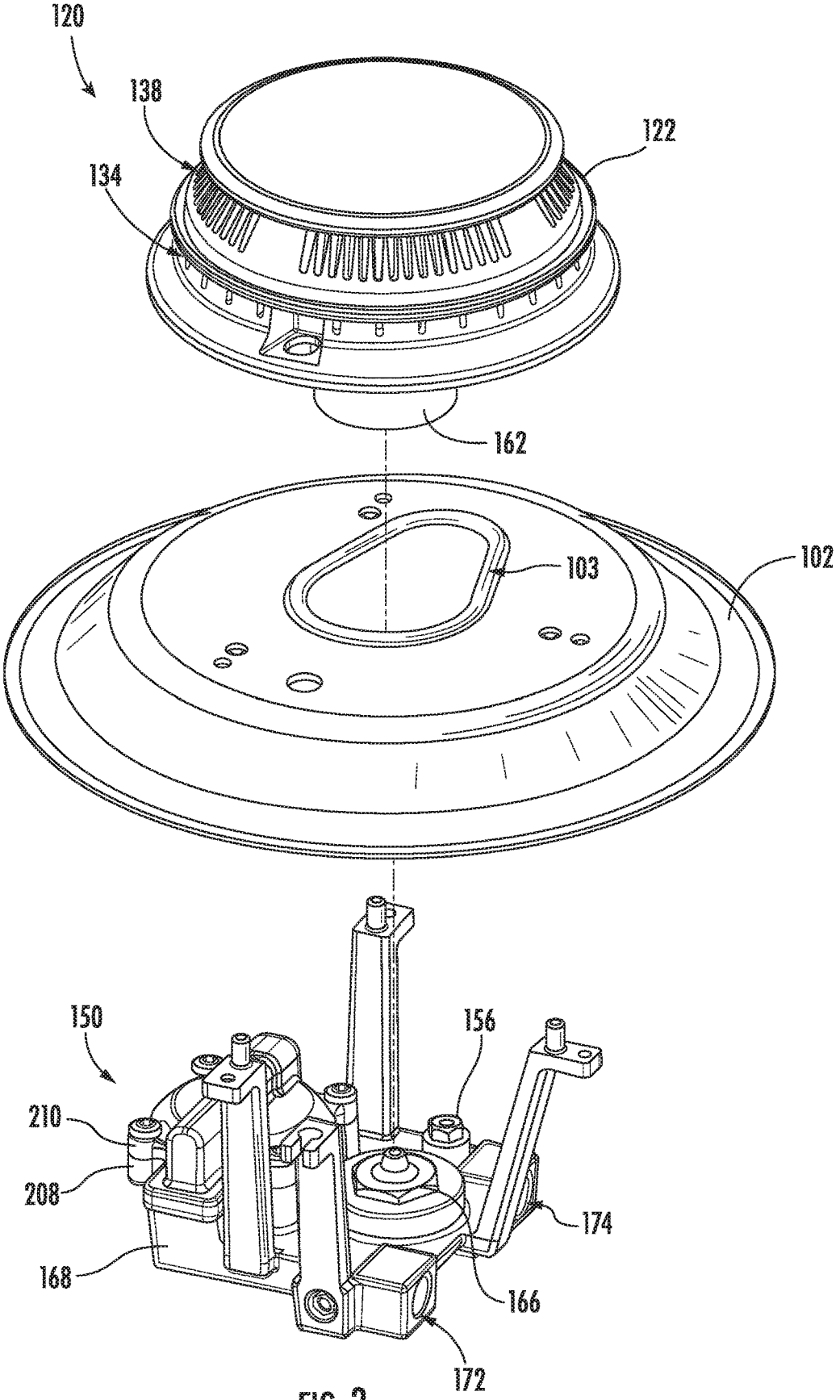
FIG. 3 is an exploded view of the example gas burner of assembly FIG. 2.
Figure 4:
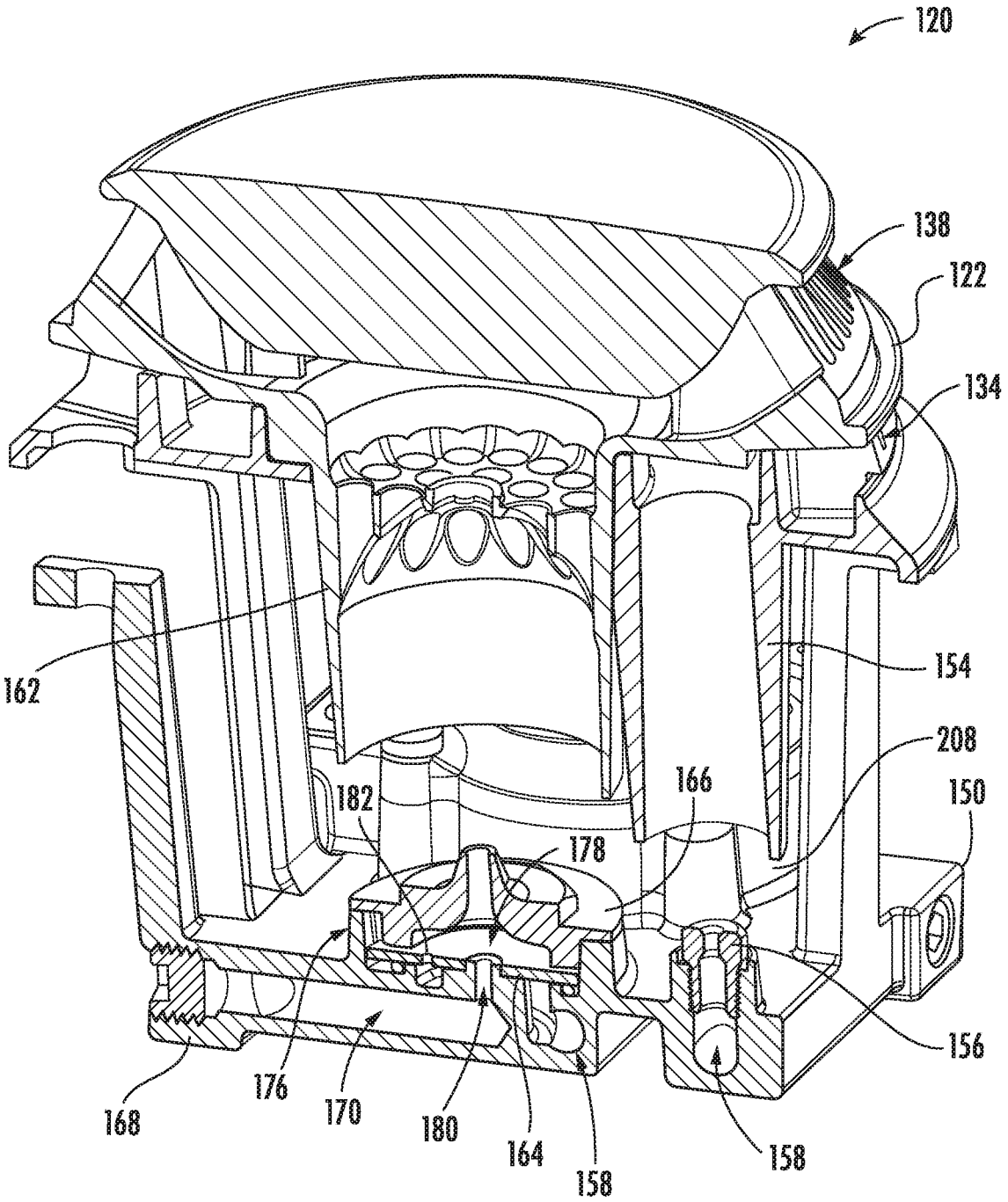
FIG. 4 is a section view of the example gas burner assembly of FIG. 2.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner for a cooktop appliance 100. Although cooktop appliance 100 is used below for the purpose of explaining the details of the present subject matter, it will be appreciated that the present subject matter may be used in or with any other suitable appliance in alternative example embodiments. For example, the gas burner described below may be used on other types of cooking appliances, such as single or double oven range appliances. Cooktop appliance 100 is used in the discussion below only for the purpose of explanation, and such use is not intended to limit the scope of the present disclosure to any particular style of appliance.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated embodiment, cooktop appliance 100 is generally referred to as a "gas cooktop," and heating elements 104 are gas burners. For example, one or more of the gas burners in cooktop appliance 100 may be a gas burner 120 described below. As illustrated, heating elements 104 are positioned on and/or within top panel 102 and have various sizes, as shown in FIG. 1, so as to provide for the receipt of cooking utensils (i.e., pots, pans, etc.) of various sizes and configurations and to provide different heat inputs for such cooking utensils.

In addition, cooktop appliance 100 may include one or more grates 106 configured to support a cooking utensil, such as a pot, pan, etc. In general, grates 106 include a plurality of elongated members 108, e.g., formed of cast metal, such as cast iron. The cooking utensil may be placed on the elongated members 108 of each grate 106 such that the cooking utensil rests on an upper surface of elongated members 108 during the cooking process. Heating elements 104 are positioned underneath the various grates 106 such that heating elements 104 provide thermal energy to cooking utensils above top panel 102 by combustion of fuel below the cooking utensils.

According to the illustrated example embodiment, a user interface panel or control panel 110 is located within convenient reach of a user of cooktop appliance 100. For this example embodiment, control panel 110 includes control knobs 112 that are each associated with one of heating elements 104. Control knobs 112 allow the user to activate each heating element 104 and regulate the amount of heat input each heating element 104 provides to a cooking utensil located thereon, as described in more detail below. Although cooktop appliance 100 is illustrated as including control knobs 112 for controlling heating elements 104, it will be understood that control knobs 112 and the configuration of cooktop appliance 100 shown in FIG. 1 is provided by way of example only. More specifically, control panel 110 may include various input components, such as one or more of a variety of touch-type controls, electrical, mechanical or electro-mechanical input devices including rotary dials, push buttons, and touch pads.

According to the illustrated embodiment, control knobs 112 are located within control panel 110 of cooktop appliance 100. However, it should be appreciated that this location is used only for the purpose of explanation, and that other locations and configurations of control panel 110 and control knobs 112 are possible and within the scope of the present subject matter. Indeed, according to alternative embodiments, control knobs 112 may instead be located directly on top panel 102 or elsewhere on cooktop appliance 100, e.g., on a backsplash, front bezel, or any other suitable surface of cooktop appliance 100. Control panel 110 may also be provided with one or more graphical display devices, such as a digital or analog display device designed to provide operational feedback to a user.

Turning now to FIGS. 2 through 8, a gas burner 120 according to an example embodiment of the present disclosure is described. Gas burner 120 may be used in cooktop appliance 100, e.g., as one of heating elements 104. Thus, gas burner 120 is described in greater detail below in the context of cooktop appliance 100. However, it will be understood that gas burner 120 may be used in or with any other suitable cooktop appliance in alternative example embodiments.

Gas burner 120 includes a burner body 122. Burner body 122 generally defines a first burner ring or stage (e.g., a primary burner 130) and a second burner ring or stage (e.g., a boost burner 132). More specifically, primary burner 130 generally includes a plurality of naturally aspirated or primary flame ports 134 and a primary fuel chamber 136 which are defined at least in part by burner body 122. Similarly, boost burner 132 generally includes a plurality of forced air or boost flame ports 138 and a boost fuel chamber 140 which are defined at least in part by burner body 122.

As illustrated, primary flame ports 134 and boost flame ports 138 may both be distributed in rings on burner body 122. In addition, primary flame ports 134 may be positioned concentric with boost flame ports 138. Further, primary flame ports 134 (and primary burner 130) may be positioned below boost flame ports 138 (and boost burner 132). Such positioning of primary burner 130 relative to boost burner 132 may improve combustion of gaseous fuel when gas burner assembly 120 is set to the boost position. For example, flames at primary burner 130 may assist with lighting gaseous fuel at boost burner 132 due to the position of primary burner 130 below boost burner 132.

With reference to FIGS. 2 through 8, gas burner 120 also includes an injet assembly 150. Injet assembly 150 may be positioned below top panel 102, e.g., below an opening 103 (FIG. 3) of top panel 102. Conversely, burner body 122 may be positioned on top panel 102, e.g., over opening 103 of top panel 102. Thus, burner body 122 may cover opening 103 of top panel 102 when burner body 122 is positioned on top panel 102. When burner body 122 is removed from top panel 102, injet assembly 150 below top panel 102 is accessible through opening 103. Thus, e.g., a fuel orifice(s) of gas burner 120 on injet assembly 150 may be accessed by removing burner body 122 from top panel 102, and an installer may reach through opening 103 (e.g., with a wrench or other suitable tool) to change out the fuel orifice(s) of gas burner 120.

Injet assembly 150 is configured for directing a flow of gaseous fuel to primary flame ports 134 of burner body 122. Thus, injet assembly 150 may be coupled to a gaseous fuel source 152, as described in more detail below with reference to FIG. 10. During operation of gas burner 120, gaseous fuel from gaseous fuel source 152 may flow from injet assembly 150 into a vertical Venturi mixing tube 154. In particular, injet assembly 150 includes a first gas orifice 156 that is in fluid communication with a gas passage 158. A jet of gaseous fuel from gaseous fuel source 152 may exit injet assembly 150 at first gas orifice 156 and flow towards vertical Venturi mixing tube 154. Between first gas orifice 156 and vertical Venturi mixing tube 154, the jet of gaseous fuel from first gas orifice 156 may entrain air into vertical Venturi mixing tube 154. Air and gaseous fuel may mix within vertical Venturi mixing tube 154 prior to flowing into primary fuel chamber 136 and through primary flame ports 134 where the mixture of air and gaseous fuel may be combusted.

Injet assembly 150 is also configured for directing a flow of air and gaseous fuel to boost flame ports 138 of burner body 122. Thus, as discussed in greater detail below, injet assembly 150 may be coupled to pressurized air source 160 in addition to gaseous fuel source 152. During boosted operation of gas burner 120, a mixed flow of gaseous fuel from gaseous fuel source 152 and air from pressurized air source 160 may flow from injet assembly 150, through an inlet tube 162, and into boost fuel chamber 140 prior to flowing to boost flame ports 138 where the mixture of gaseous fuel and air may be combusted at boost flame ports 138.

In addition to first gas orifice 156, injet assembly 150 also includes a second gas orifice 164, a mixed outlet nozzle 166, and an injet body 168. Injet body 168 defines an air passage 170 and gas passage 158. Air passage 170 may be in fluid communication with pressurized air source 160. For example, a pipe or conduit may extend between pressurized air source 160 and injet body 168, and pressurized air from pressurized air source 160 may flow into air passage 170 via such pipe or conduit. Gas passage 158 may be in fluid communication with gaseous fuel source 152. For example, a pipe or conduit may extend between gaseous fuel source 152 and injet body 168, and gaseous fuel from gaseous fuel source 152 may flow into gas passage 158 via such pipe or conduit. In certain example embodiments, injet body 168 defines a single inlet 172 for air passage 170 through which the pressurized air from pressurized air source 160 may flow into air passage 170, and injet body 168 defines a single inlet 174 for gas passage 158 through which the pressurized air from gaseous fuel source 152 may flow into gas passage 158.

First gas outlet orifice 156 is mounted to injet body 168, e.g., at a first outlet of gas passage 158. Thus, gaseous fuel from gaseous fuel source 152 may exit gas passage 158 through first gas outlet orifice 156, and gas passage 158 is configured for directing a flow of gaseous fuel through injet body 168 to first gas outlet orifice 156. On injet body 168, first gas outlet orifice 156 is oriented for directing a flow of gaseous fuel towards vertical Venturi mixing tube 154 and/or primary flame ports 134, as discussed above.

Second gas orifice 164 and injet body 168, e.g., collectively, form an eductor mixer 176 within a mixing chamber 178 of injet body 168. Eductor mixer 176 is configured for mixing pressurized air from air passage 170 with gaseous fuel from gas passage 158 in mixing chamber 178. In particular, an outlet 180 of air passage 170 is positioned at mixing chamber 178. A jet of pressurized air from pressurized air source 160 may flow from air passage 170 into mixing chamber 178 via outlet 180 of air passage 170. Second gas orifice 164 is positioned within injet body 168 between mixing chamber 178 and gas passage 158. Gaseous fuel from gaseous fuel source 152 may flow from gas passage 158 into mixing chamber 178 via second gas orifice 164. As an example, second gas orifice 164 may be a plate that defines a plurality of through holes 182, and the gaseous fuel in gas passage 158 may flow through holes 182 into mixing chamber 178.

The jet of pressurized air flowing into mixing chamber 178 via outlet 180 of air passage 170 may draw and entrain gaseous fuel flowing into mixing chamber 178 via second gas orifice 164. In addition, as the gaseous fuel is entrained into the air, a mixture of air and gaseous fuel is formed within mixing chamber 178. From mixing chamber 178, the mixture of air and gaseous fuel may flow from mixing chamber 178 via mixed outlet nozzle 166. In particular, mixed outlet nozzle 166 is mounted to injet body 168 at mixing chamber 178, and mixed outlet nozzle 166 is oriented on injet body 168 for directing the mixed flow of air and gaseous fuel from mixing chamber 178, through inlet tube 162, into boost fuel chamber 140, and/or towards boost flame ports 138, as discussed above.

Burner body 122 may be positioned over injet body 168, e.g., when burner body 122 is positioned on top panel 102. In addition, first gas orifice 156 may be oriented on injet body 168 such that first gas orifice 156 directs the flow of gaseous fuel upwardly towards vertical Venturi mixing tube 154 and primary flame ports 134. Similarly, mixed outlet nozzle 166 may be oriented on injet body 168 such that mixed outlet nozzle 166 directs the mixed flow of air and gaseous fuel upwardly towards inlet tube 162 and boost flame ports 138.

First and second gas orifices 156, 164 may be removeable from injet body 168. First and second gas orifices 156, 164 may also be positioned on injet body 168 directly below burner body 122, e.g., when burner body 122 is positioned on top panel 102. Thus, e.g., first and second gas orifices 156, 164 may be accessed by removing burner body 122 from top panel 102, and an installer may reach through opening 103 (e.g., with a wrench or other suitable tool) to change out first and second gas orifices 156, 164.

Injet assembly 150 also includes a pneumatically actuated gas valve 200. Pneumatically actuated gas valve 200 may be positioned within injet body 168, and pneumatically actuated gas valve 200 is adjustable between a closed configuration and an open configuration. In the closed configuration, pneumatically actuated gas valve 200 blocks the flow of gaseous fuel through gas passage 158 to second gas orifice 164, eductor mixer 176, and/or mixed outlet nozzle 166. Conversely, pneumatically actuated gas valve 200 permits the flow of gaseous fuel through gas passage 158 to second gas orifice 164/eductor mixer 176 in the open configuration. Pneumatically actuated gas valve 200 is configured to adjust from the closed configuration to the open configuration in response to the flow of air through air passage 170 to outlet 180 of air passage 170. Thus, e.g., pneumatically actuated gas valve 200 is in fluid communication with air passage 170 and opens in response to air passage 170 being pressurized by air from pressurized air source 160. As an example, pneumatically actuated gas valve 200 may be positioned on a branch of air passage 170 relative to outlet 180 of air passage 170.

It will be understood that first gas outlet orifice 156 may be in fluid communication with gas passage 158 in both the open and closed configurations of pneumatically actuated gas valve 200. Thus, first gas outlet orifice 156 may be positioned on gas passage 158 upstream of pneumatically actuated gas valve 200 relative to the flow of gas through gas passage 158. Thus, e.g., pneumatically actuated gas valve 200 may not regulate the flow of gas through second gas orifice 164 but not first gas outlet orifice 156.

Figure 5:
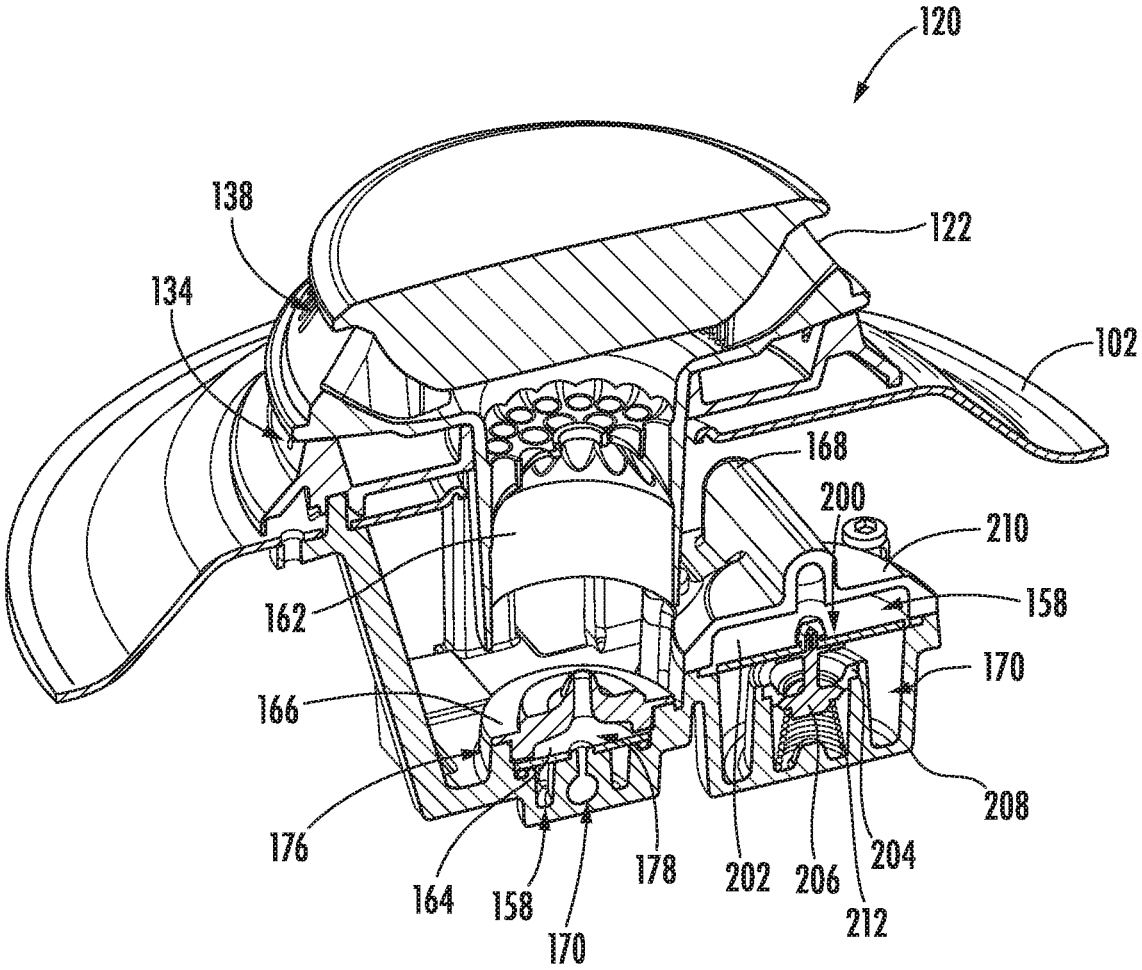
FIG. 5 is another section view of the example gas burner assembly of FIG. 2.
Figure 6:
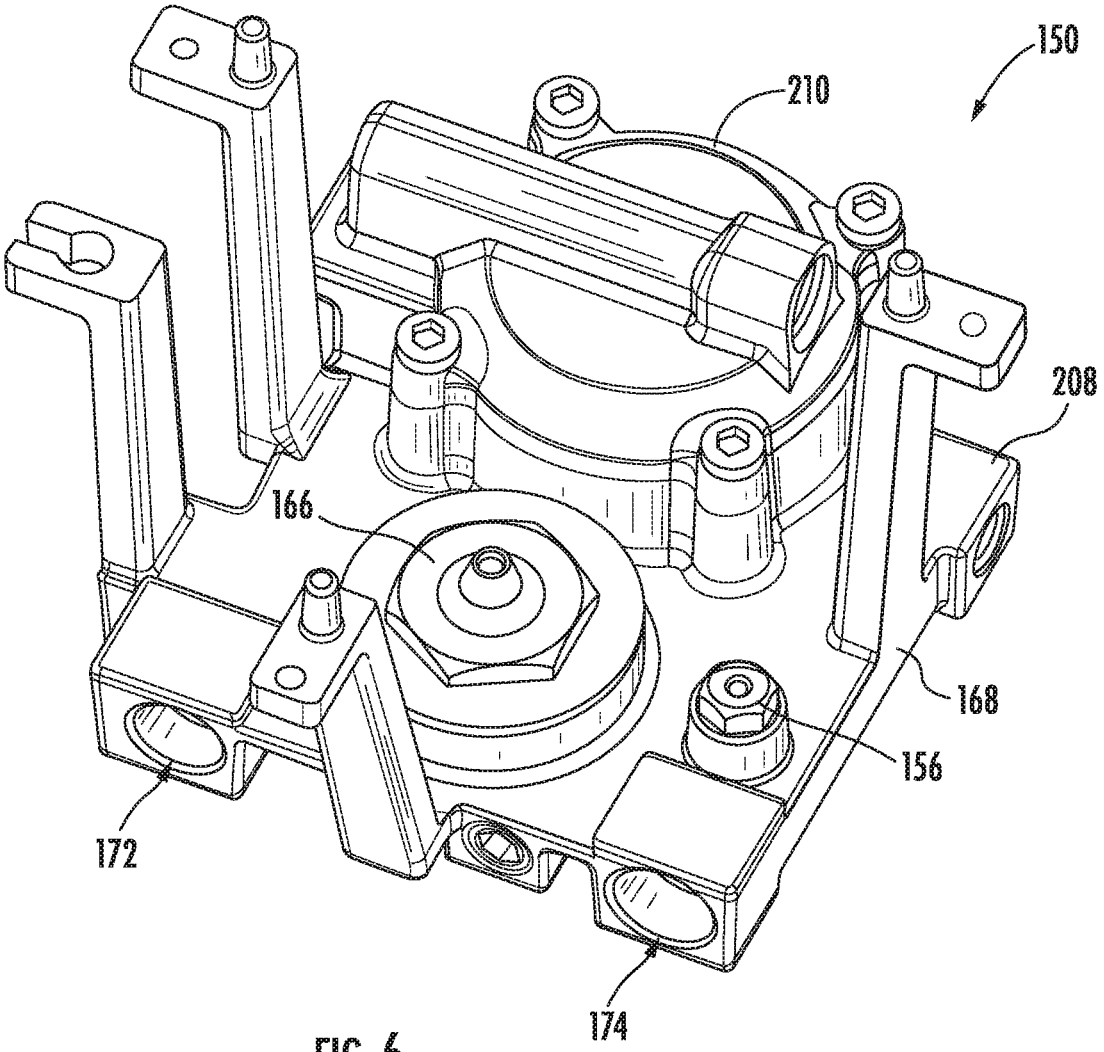
FIG. 6 is a perspective view of an injet of the example gas burner assembly of FIG. 2.
Figure 7:
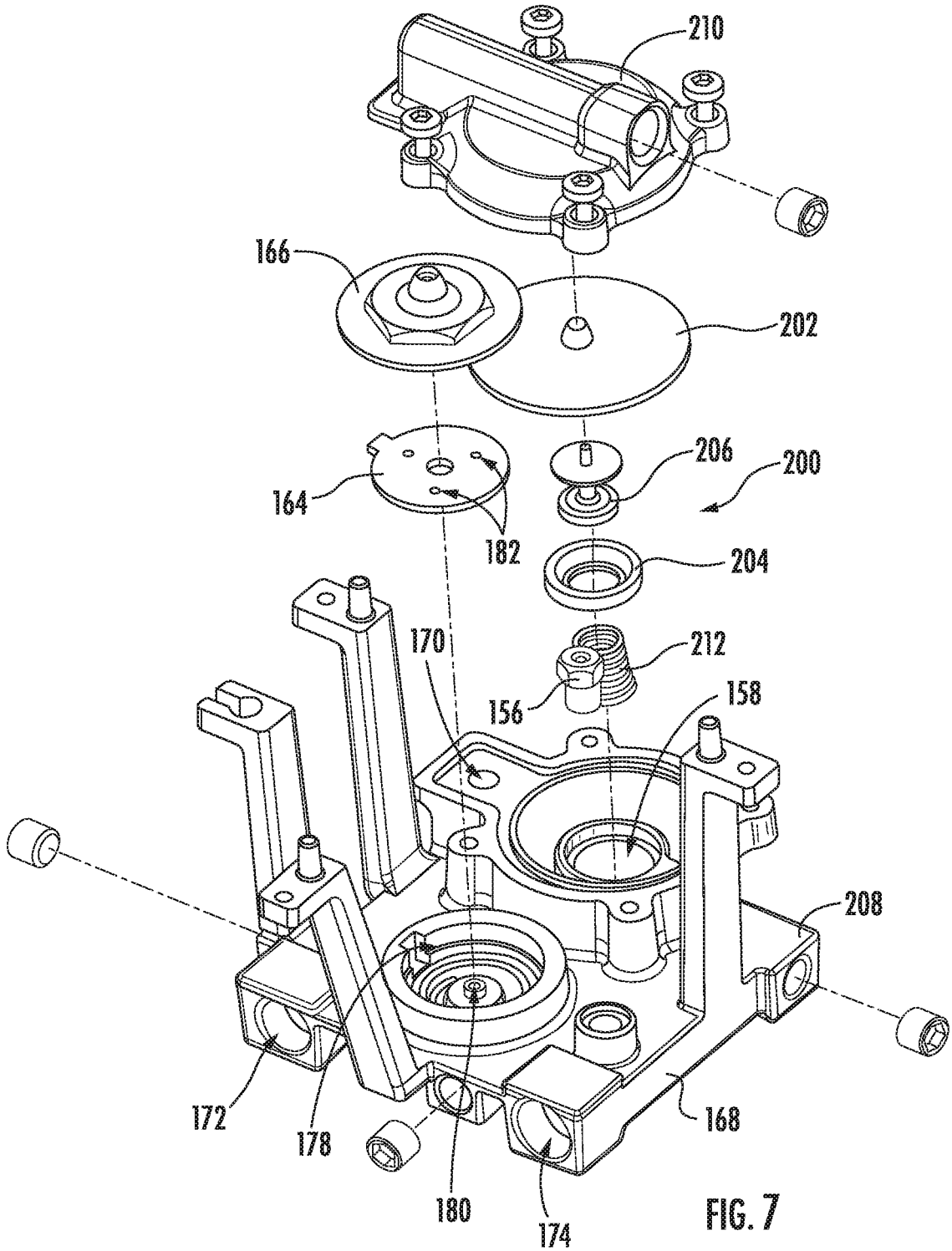
FIG. 7 is an exploded view of the injet of FIG. 7.
Figure 8:
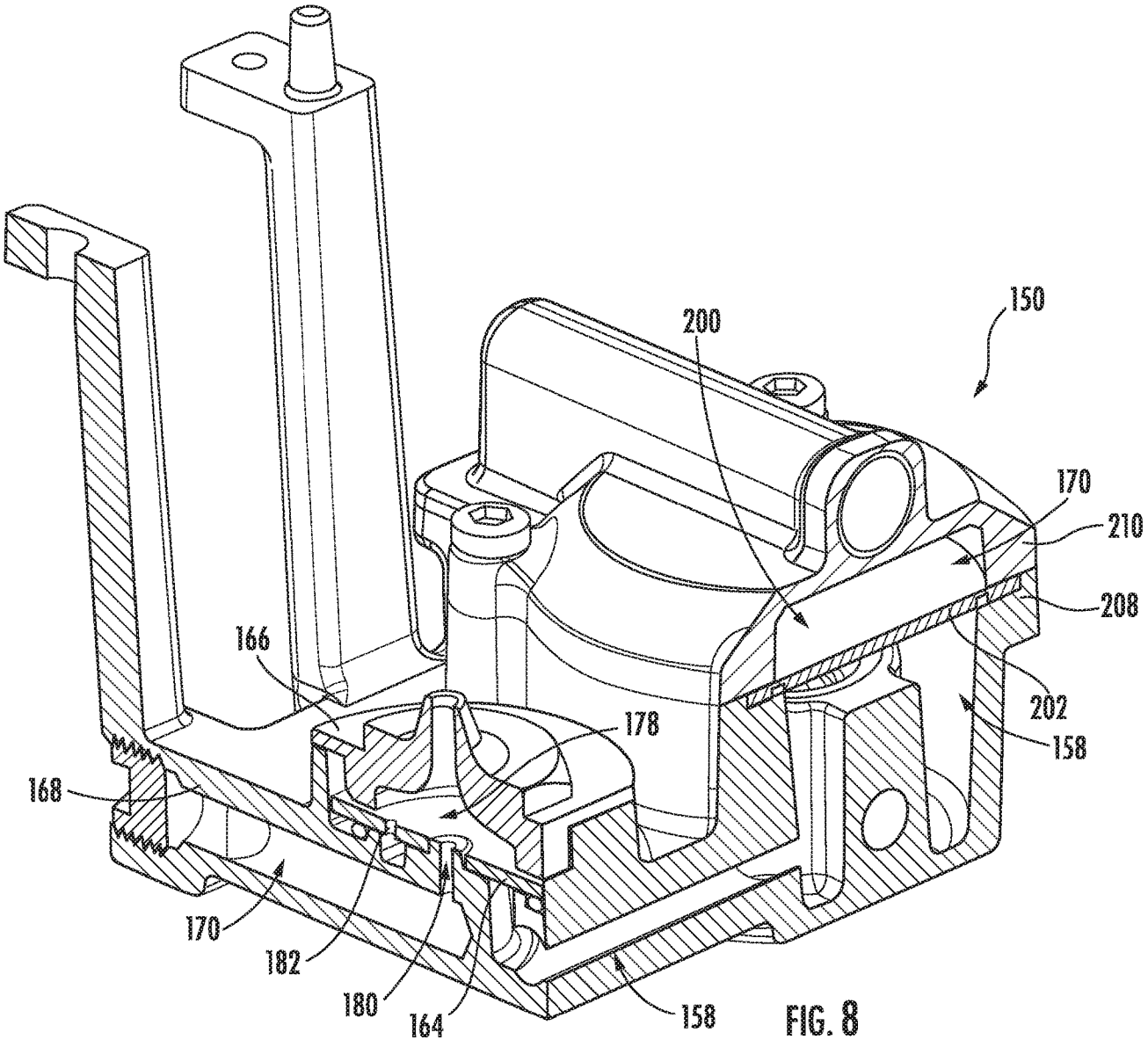
FIG. 8 is a section view of the injet of FIG. 7.

As shown in FIGS. 5 and 7, pneumatically actuated gas valve 200 includes a diaphragm 202, a seal 204, and a plug 206. Diaphragm 202 is positioned between air passage 170 and gas passage 158 within injet body 168. For example, diaphragm 202 may be circular and may be clamped between a first injet body half 208 and a second injet body half 210. In particular, first and second injet body halves 208, 210 may be fastened together with diaphragm 202 positioned between first and second injet body halves 208, 210.

Seal 204 is mounted to injet body 168 within gas passage 158. Plug 206 is mounted to diaphragm 202, e.g., such that plug 206 travels with diaphragm 202 when diaphragm 202 deforms. Plug 206 is positioned against seal 204 when pneumatically actuated gas valve 200 is closed. A spring 212 may be coupled to plug 206. Spring 212 may urge plug 206 towards seal 204. Thus, pneumatically actuated gas valve 200 may be normally closed.

When air passage 170 is pressurized by air from pressurized air source 160, diaphragm 202 may deform due to the pressure of air in air passage 170 increasing, and plug 206 may shift away from seal 204 as diaphragm 202 deforms. In such a manner, diaphragm 202, seal 204, and plug 206 may cooperate to open pneumatically actuated gas valve 200 in response to air passage 170 being pressurized by air from pressurized air source 160. Conversely, diaphragm 202 may return to an undeformed state when air passage 170 is no longer pressurized by air from pressurized air source 160, and plug 206 may shift against seal 204. In such a manner, diaphragm 202, seal 204 and plug 206 may cooperate to close pneumatically actuated gas valve 200 in response to air passage 170 no longer being pressurized by air from pressurized air source 160.

Operation of cooktop appliance 100 and gas burner assemblies 120 may be controlled by electromechanical switches or by a controller or processing device 220 (FIGS. 1 and 9) that is operatively coupled to control panel 110 for user manipulation, e.g., to control the operation of heating elements 104. In response to user manipulation of control panel 110 (e.g., via control knobs 112 and/or a touch screen interface), controller 220 operates the various components of cooktop appliance 100 to execute selected instructions, commands, or other features.

As described in more detail below with respect to FIG. 9, controller 220 may include a memory and microprocessor, such as a general or special purpose microprocessor operable to execute programming instructions or micro-control code associated with appliance operation. Alternatively, controller 220 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of cooktop appliance 100 may be in communication with controller 220 via one or more signal lines or shared communication busses.

Figure 9:
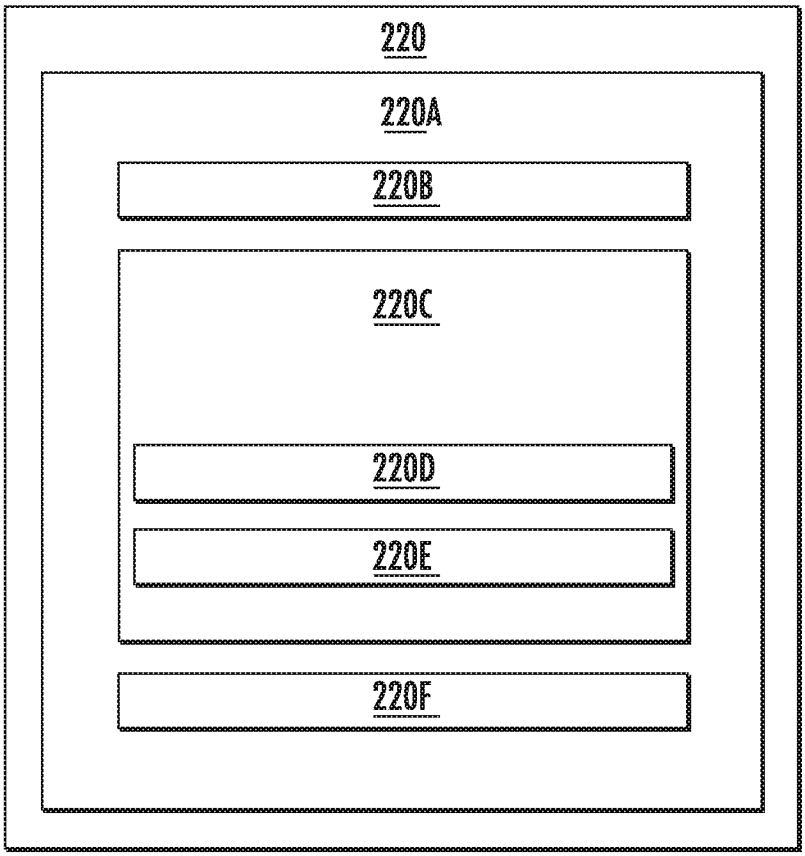
FIG. 9 depicts certain components of a controller according to example embodiments of the present subject matter.

FIG. 9 depicts certain components of controller 220 according to example embodiments of the present disclosure. Controller 220 can include one or more computing device(s) 220A which may be used to implement methods as described herein. Computing device(s) 220A can include one or more processor(s) 220B and one or more memory device(s) 220C. The one or more processor(s) 220B can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 220C can include one or more non-transitory computer-readable storage medium(s), such as RAM, ROM, EEPROM, EPROM, flash memory devices, magnetic disks, etc., and/or combinations thereof.

The memory device(s) 220C can include one or more computer-readable media and can store information accessible by the one or more processor(s) 220B, including instructions 220D that can be executed by the one or more processor(s) 220B. For instance, the memory device(s) 220C can store instructions 220D for running one or more software applications, displaying a user interface, receiving user input, processing user input, etc. In some implementations, the instructions 220D can be executed by the one or more processor(s) 220B to cause the one or more processor(s) 220B to perform operations, e.g., such as one or more portions of methods described herein. The instructions 220D can be software written in any suitable programming language or can be implemented in hardware. Additionally, and/or alternatively, the instructions 220D can be executed in logically and/or virtually separate threads on processor(s) 220B.

The one or more memory device(s) 220C can also store data 220E that can be retrieved, manipulated, created, or stored by the one or more processor(s) 220B. The data 220E can include, for instance, data to facilitate performance of methods described herein. The data 220E can be stored in one or more database(s). The one or more database(s) can be connected to controller 220 by a high bandwidth LAN or WAN, or can also be connected to controller through one or more networks (not shown). The one or more database(s) can be split up so that they are located in multiple locales. In some implementations, the data 220E can be received from another device.

The computing device(s) 220A can also include a communication module or interface 220F used to communicate with one or more other component(s) of controller 220 or cooktop appliance 100 over the network. The communication interface 220F can include any suitable components for interfacing with one or more network(s), including for example, transmitters, receivers, ports, controllers, antennas, or other suitable components.

Figure 10:
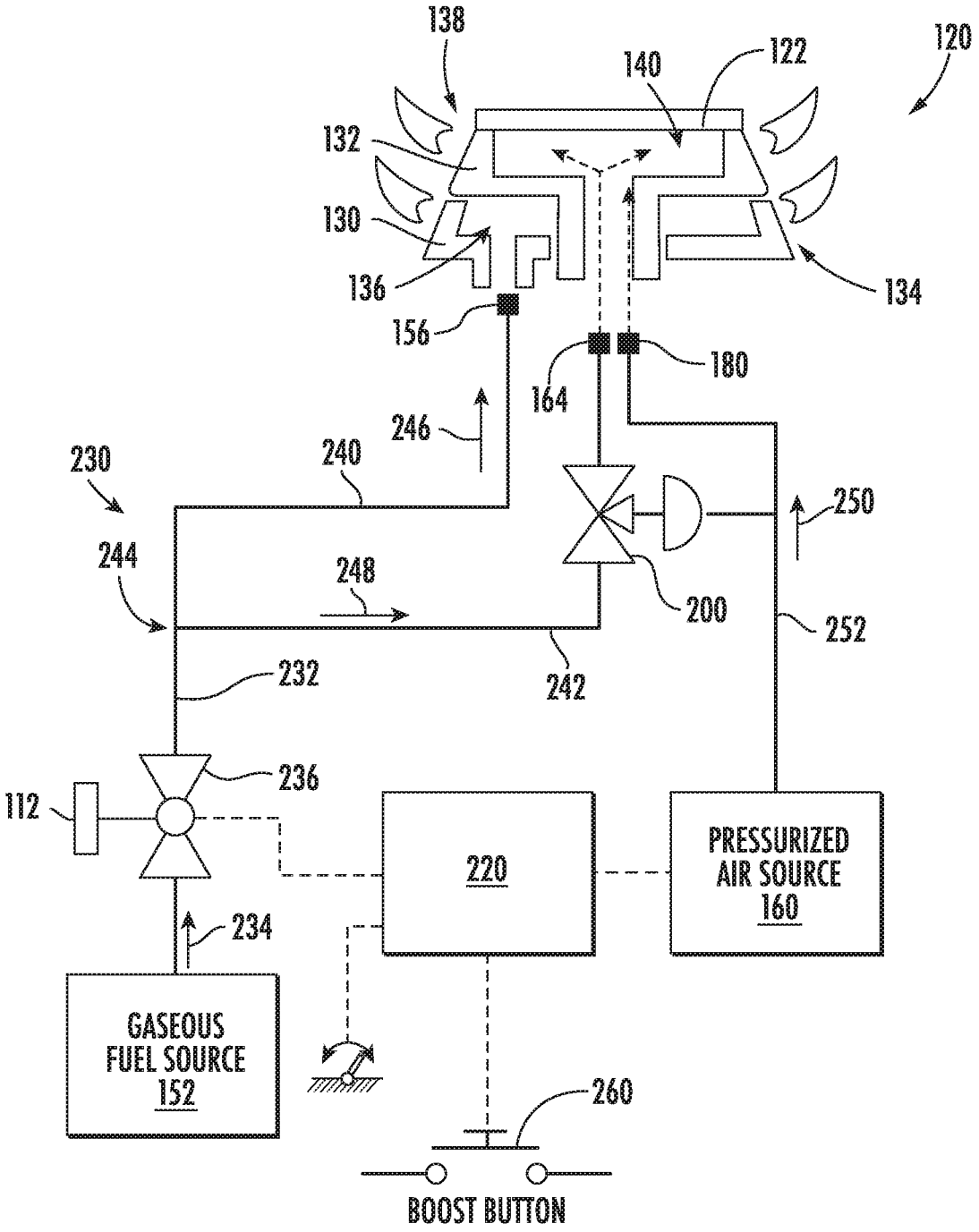
FIG. 10 is a schematic view of a gas burner assembly and a fuel supply system according to an example embodiment of the present subject matter.

Referring now to FIG. 10, a schematic view of gas burner assembly 120 and a fuel supply system 230 will be described. In general, fuel supply system 230 is configured for selectively supplying gaseous fuel such as propane or natural gas to primary burner 130 and boost burner 132 to regulate the amount of heat generated by the respective stages. In particular, fuel supply system 230 is configured for selectively supplying gaseous fuel to only primary burner 130 or to both primary burner 130 and boost burner 132 depending upon the desired output of gas burner assembly 120 selected by a user of gas burner assembly 120. Thus, primary burner 130 is separate or independent from boost burner 132, e.g., such that primary burner 130 is not in fluid communication with boost burner 132 within gas burner assembly 120. In such manner, gaseous fuel within gas burner assembly 120 does not flow between primary burner 130 and boost burner 132.

As shown in FIG. 10, fuel supply system 230 includes a supply line 232 that may be coupled to pressurized gaseous fuel source 152, such as a natural gas supply line or a propane tank. In this manner, a flow of supply fuel (indicated by arrow 234), such as gaseous fuel (e.g., natural gas or propane), is flowable from the pressurized gaseous fuel source 152 into supply line 232. Fuel supply system 230 further includes a fuel regulating device 236 operably coupled to supply line 232 for selectively directing a metered amount of fuel to primary burner 130 and boost burner 132.

More specifically, according to an exemplary embodiment, control knob 112 may be operably coupled to fuel regulating device 236 for regulating the flow of supply fuel 234. In this regard, a user may rotate control knob 112 to adjust the position of fuel regulating device 236 and the flow of supply fuel 234 through supply line 232. In particular, gas burner assembly 120 may have a respective heat output at each position of control knob 112 (and fuel regulating device 236), e.g., an off, high, medium, and low position. In addition, control knob 112 may be rotated to a lighting position to supply a suitable amount of gaseous fuel to primary burner 130 for ignition, which may be simultaneously achieved using, e.g., a spark electrode (not shown).

As best shown in FIG. 10, supply line 232 is split into a first branch (e.g., a primary fuel conduit 240) and a second branch (e.g., a boost fuel conduit 242) at a junction 244, e.g., via a plumbing tee, wye, or any other suitable splitting device. In general, primary fuel conduit 240 extends from junction 244 to an orifice for primary flame ports 134 (such as first gas orifice 156), which is positioned for directing a flow of primary fuel 246 into gas burner assembly 120, or more particularly into primary burner 130. Similarly, boost fuel conduit 242 extends from junction 244 to an orifice for boost flame ports 138 (such as second gas orifice 164 or holes 182 defined therein), which is positioned for directing a flow of boost fuel 248 into boost burner 132. Thus, supply line 232 is positioned upstream of primary and boost fuel conduits 240, 242 relative to a flow of gaseous fuel from fuel source 152 and primary and boost fuel conduits 240, 242 may separately supply the gaseous fuel from supply line 232 to primary burner 130 and boost burner 132.

As explained above, boost burner 132 is a forced air or mechanically aspirated burner. As illustrated, fuel supply system 230 includes a pressurized air source 160 which is generally configured for providing the flow of combustion air 250 to boost burner 132 for mixing with boost flow of fuel 248. In this regard, for example, fuel supply system 230 includes an air supply conduit 252 that provides fluid communication between pressurized air source 160 and boost fuel chamber 140, or more specifically, outlet 180 of air passage 172. It should be appreciated that any suitable type, position, and configuration of pressurized air source 160 is possible and within the scope of the present subject matter. For example, according to an exemplary embodiment, pressurized air source 160 may be a bellows-style air pump, a fan, such as an axial or centrifugal fan, or any other device suitable for urging a flow of combustion air, such as an air compressor or a centralized compressed air system. Pressurized air source 160 may be configured for supplying the flow of combustion air 250 at any suitable gage pressure, such as a half to one psig.

As described above, fuel supply system 230 includes pneumatically actuated gas valve 200, which is a pressure controlled valve operably coupled with pressurized air source 160 and to boost fuel conduit 242. Pneumatically actuated gas valve 200 is generally configured for regulating the flow of boost fuel 248 passing through boost fuel conduit 242, as described in detail above. Specifically, pneumatically actuated gas valve 200 is configured for stopping the flow of boost fuel 248 when a pressure of the flow of air 250 drops below a predetermined pressure or threshold.

As shown in FIG. 10, a boost button 260 may be operably coupled to pressurized air source 160 through controller 220. In this regard, boost button 260 may be a momentary push button, a toggle switch, or any other suitable button or switch that is operably coupled with controller 220 for providing an indication to gas burner assembly 120 and pressurized air source 160 to enter boost mode. Thus, when boost burner button 260 is pressed, controller 220 may operate pressurized air source 160 to start boost mode operation. As an example, boost flame ports 138 may be activated by pressing a boost burner button 260 on control panel 110. In response to a user actuating boost burner button 260, pressurized air source 160 may be activated, e.g., with a timer control or with controller 220.

Referring still to FIG. 10, gas burner assembly 120 may include a fuel type switch 262 which is operably coupled to controller 220. Fuel type switch 262 is generally configured for informing controller 220 what type of fuel is being used with gas burner assembly 120. For example, gas burner assembly 120 may be configured for operating using any suitable gaseous fuel such as propane, natural gas, butane, etc. However, the appropriate amount of air supplied to boost burner 132 may vary depending on the fuel type used. Thus, for example, if a user or maintenance technician modifies gas burner assembly 120 to operate with a compatible fuel that is different than that for which the burner and pressurized air source 160 are programmed, the fuel type switch 262 may be used to adjust operation of the pressurized air source 160 accordingly. Similar to boost button 260, fuel type switch 262 may be a momentary push button, a toggle switch, or any other suitable button or switch that is operably coupled with controller 220 for providing an indication as to the type of fuel used.

Now that the construction and configuration of gas burner assembly 120 and fuel supply system 230 have been described according to exemplary embodiments of the present subject matter, an exemplary method 300 for operating a gas burner assembly will be described according to an exemplary embodiment of the present subject matter. Method 300 can be used to operate gas burner assembly 120, or any other suitable heating element or cooktop appliance. In this regard, for example, controller 220 may be configured for implementing some or all steps of method 300. Further, it should be appreciated that the exemplary method 300 is discussed herein only to describe exemplary aspects of the present subject matter, and is not intended to be limiting.

Figure 11:
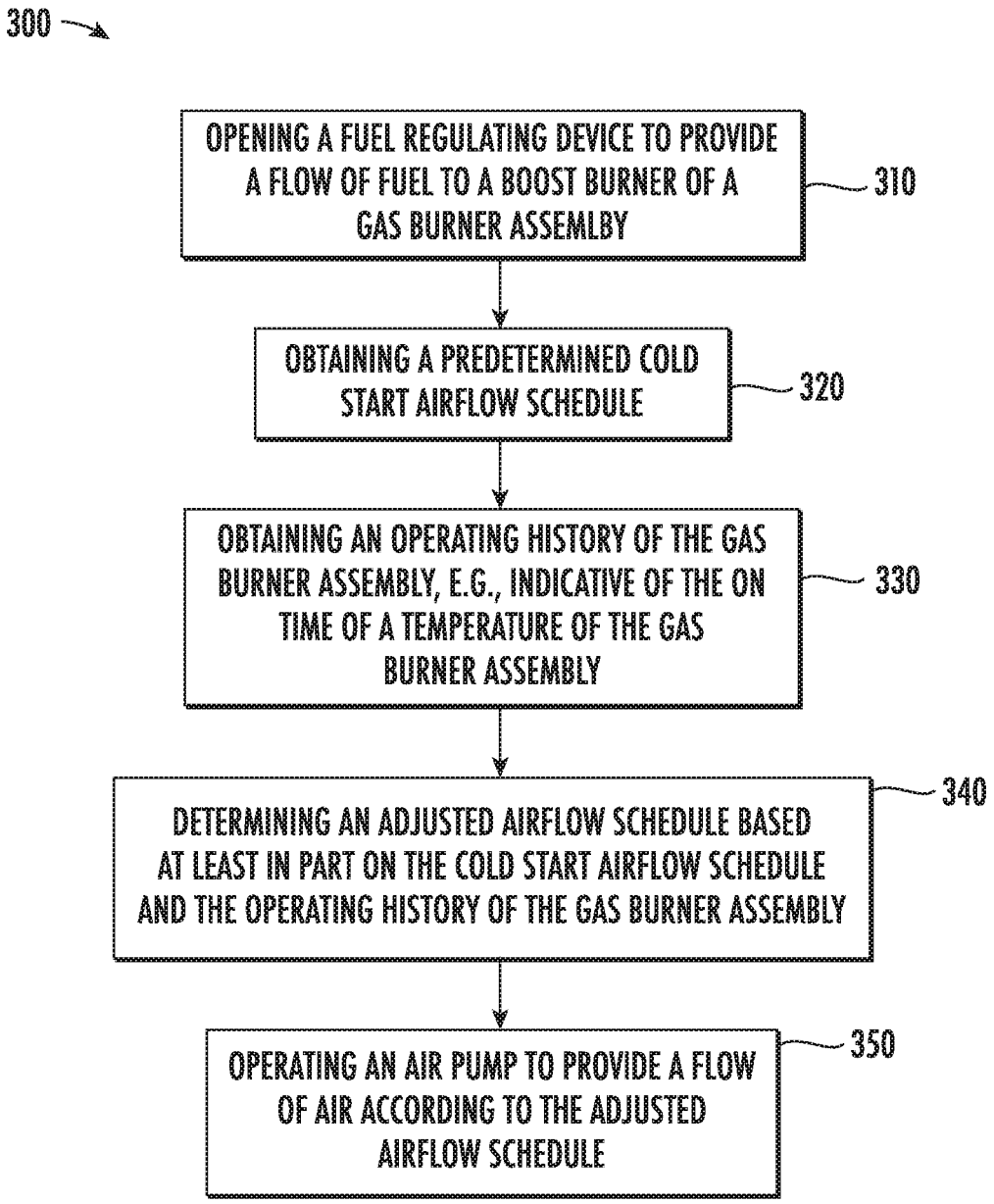
FIG. 11 is a method of operating a gas burner assembly in accordance with one embodiment of the present disclosure.

Referring now to FIG. 11, method 300 includes, at step 310, opening a fuel regulating device to provide a flow of fuel to a boost burner of the gas burner assembly. Specifically, continuing the example from above, when a user wishes to initiate the boost burner of gas burner assembly 120, they may press boost burner button 260. The pressing of this button initiates a boost burner mode where a flow of fuel, e.g., the boost flow of fuel 248, and a flow of air 250 are provided into boost fuel chamber 142 where they may mix prior to combustion. According to alternative embodiments, the boost mode may be initiated in any other suitable manner while remaining within the scope of the present subject matter.

As explained above, when fuel regulating device 236 is opened to initiate the boost burner 132, the desired flow rate of flow of air 250 for improved combustion, efficiency, and performance may be dependent upon the temperature of gas burner assembly 120. Specifically, for example, as the temperature of gas burner assembly 120 and its associated surfaces increases, the flow of air 250 may be preheated such that its density is reduced. To compensate for such an air density reduction, the flow rate of flow of air 250 may be increased as the temperature of gas burner assembly 120 increases to maintain a desired fuel/air ratio. Method 300 described herein provides exemplary means for achieving such temperature-compensated combustion air flow.

Specifically, step 320 includes obtaining a predetermined cold start airflow schedule. In general, the cold start airflow schedule refers to the desirable or optimum flow rate of the flow of air 250 over time as boost burner 132 is operated from initial ignition to steady state. For example, referring to FIG. 12, an exemplary cold start airflow schedule is identified with reference numeral 270. Notably, the cold start airflow schedule 270 may be a time-varying air flow rate for improved combustion when gas burner assembly 120 is being operated in boost mode (e.g., from t=0 to approximately t=13 minutes in FIG. 12). Notably, the cold start airflow schedule 270 may be predetermined based on empirical testing, theoretical models, or in any other suitable manner. In addition, the cold start airflow schedule 270 may be stored in controller 220 in any suitable manner, such as a data or lookup table, mathematical algorithm, etc.

In addition, as explained briefly above, the cold start airflow schedule 270 may vary depending on the type of fuel used with gas burner assembly 120. Thus, according to an exemplary embodiment, step 320 of obtaining the predetermined cold start airflow schedule may include obtaining a fuel type of the flow of fuel and selecting the cold start airflow schedule based at least in part on the fuel type. For example, the data or lookup table stored on a controller 220 may include a specific time varying cold start airflow schedule 270 for each fuel type used. In this manner, a user may provide an indication to controller 220 as to the type of fuel being used (e.g., using the fuel type switch 262), and air pump 160 may operate to provide the flow of air according to a cold start airflow schedule 270 corresponding to the type of fuel being used.

Figure 12:
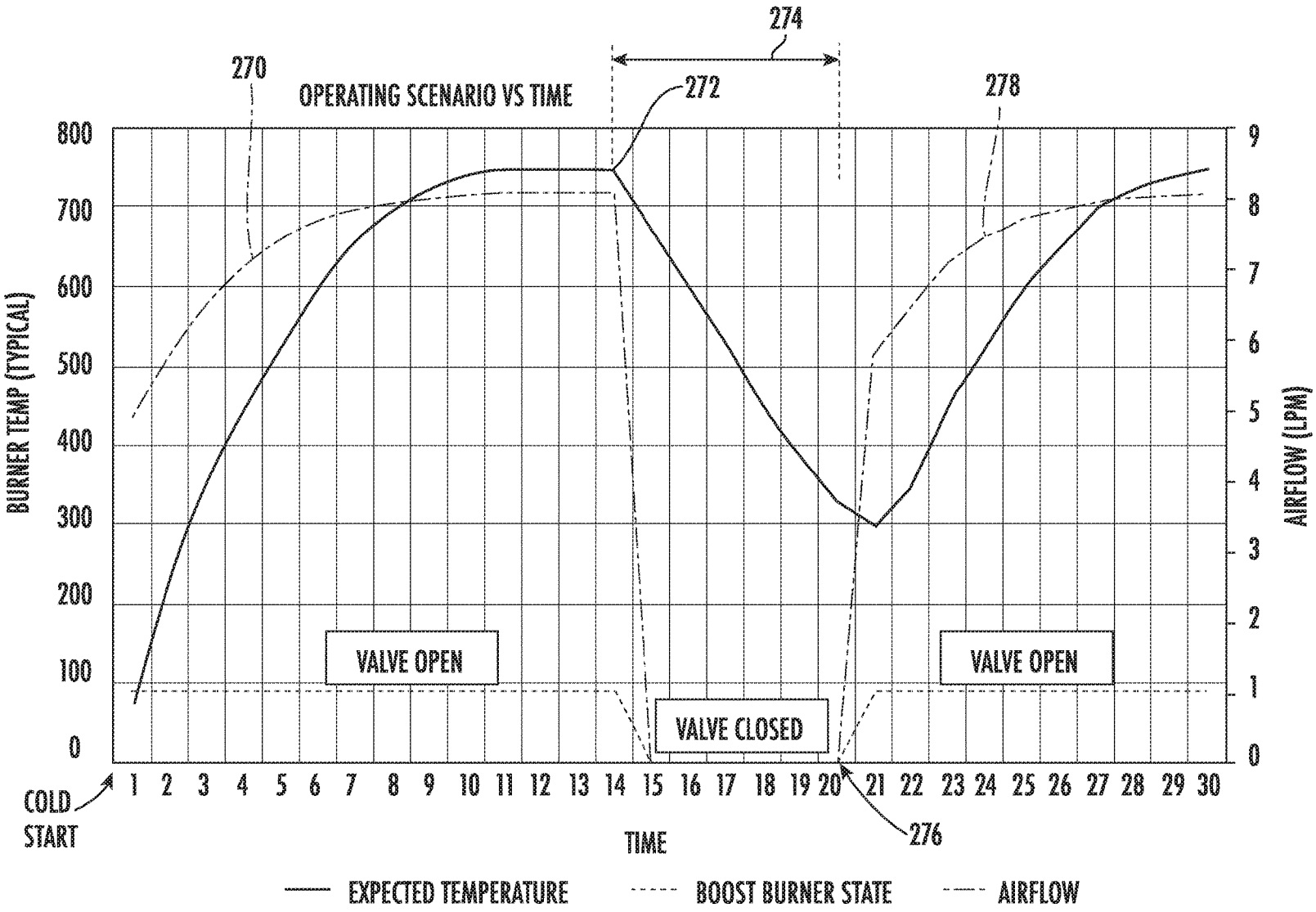
FIG. 12 provides a plot illustrating the operating temperature of a gas burner assembly and corresponding airflow schedules according to an exemplary embodiment of the present subject matter.

As shown in FIG. 12, when the boost mode is initiated (e.g., at t=0), gas burner assembly 120 is in a COLD state or condition. In other words, gas burner assembly 120 is considered to be COLD when it is substantially at or near room temperature (e.g., 72° F.), when it is below a first temperature threshold (e.g., approximately 100° F.), or when the temperature of gas burner assembly 120 otherwise has a negligible effect on the density of the flow of air 250. It should be appreciated that the limits that define a COLD gas burner may be set by the manufacturer based on a variety of factors such as fuel type, burner configuration, burner materials, flame port configuration, heat dissipation characteristics, etc. Further, it should be appreciated that as used herein, terms of approximation, such as "approximately," "substantially," or "about," refer to being within a twenty percent margin of error.

As illustrated, cold start airflow schedule 270 generally provides a lower flow rate of air when temperatures of gas burner assembly 120 are relatively low and the air density is high. By contrast, as the surfaces of gas burner assembly 120 heat up, the flow rate of air may be increased to compensate for the air density reduction resulting from the elevated temperatures of gas burner assembly 120. At approximately 13 minutes (t=13), fuel regulating device 236 is turned off or the boost mode is exited (e.g. as indicated by reference numeral 272). As explained below, the duration of ON and OFF condition of gas burner assembly 120 may be used to quantify an operating history gas burner assembly 120, which may in turn be used to modify the airflow provided to boost burner 132 for improved fuel/air ratios if the boost mode is reactivated before the COLD state is restored.

Referring again to FIG. 11, step 330 includes obtaining an operating history of the gas burner assembly. In this regard, the operating history is generally intended to provide an indication of the amount of time within a given time period that gas burner assembly 120 was on or its surfaces were otherwise being heated. Thus, it should be appreciated that controller 220 may monitor the ON/OFF state of gas burner assembly 120, the position of fuel regulating device 236, the presence of a flame, or any other burner characteristic which may relate to the temperature of the gas burner assembly when the boost mode is initiated.

In other words, the operating history is intended to serve as a proxy for burner temperature or may be used to make advantageous modifications to the flow of air for improved burner operation and efficiency. Although exemplary ways of quantifying the operating history of gas burner assembly 120 are provided below, it should be appreciated that any suitable manner of monitoring the operation of gas burner assembly or the temperature of its surfaces in order to provide a proxy or an indication of the air density or the desirable flow rate of combustion air may be used according to alternative embodiments. The exemplary methods described herein are not intended to limit the scope subject matter in any manner.

Based on the operating history determined at step 330, suitable adjustments to the cold airflow schedule 270 may be made for improved burner performance and efficiency. Specifically, step 340 includes determining an adjusted airflow schedule based at least in part on the cold start airflow schedule and the operating history of gas burner assembly. In addition, step 350 includes operating an air pump to provide a flow of air according to the adjusted airflow schedule.

According to one exemplary embodiment, the operating history of gas burner assembly includes a cooling time period (e.g., as indicated by reference numeral 274 in FIG. 12) measured between opening the fuel regulating device (e.g., the initiation of boost mode as identified by reference numeral 276 in FIG. 12) and the last time the fuel regulating device was closed (e.g., valve off 272). In this regard, when primary burner 130 or boost burner 132 of gas burner assembly 120 has been used recently, the surfaces of gas burner assembly 120 may still be warm or hot from the prior use. Thus, the cooling time period 274 is intended to measure the amount of time gas burner assembly 120 has had to cool back towards room temperature. Thus, if the cooling time period 274 is relatively short, the temperature of the surfaces of gas burner assembly 120 may still be elevated such that a larger adjustment of combustion air flow relative to the cold start airflow schedule 270 may be needed. By contrast, if the cooling time period 274 is relatively long, the temperature of the surfaces of gas burner assembly 120 can be close to room temperature such that subsequent initiation of the boost burner should operate using the cold start airflow schedule 270 with little or minor variation.

Specifically, according to one exemplary embodiment, the operating history of gas burner assembly 120 may provide a HOT indication if the cooling time period 274 is less than a first time threshold, may provide a WARM indication if the cooling time period 274 is greater than the first time threshold but less than a second time threshold, and may provide a COLD indication if the cooling time period 174 is greater than the second time threshold. It should be appreciated that the first time threshold and the second time threshold may vary depending on the application, manufacturer's recommendations, user preferences, type of fuel used, heat dissipation rates, etc. Moreover, there could be additional time thresholds, intermediate temperature indications, etc.

According to exemplary embodiments, the first time threshold may be between about 15 and 45 seconds (e.g., 30 seconds) and the second time threshold may be between about two minutes and ten minutes. Thus, for example, if gas burner assembly 120 was just recently turned off such that it had less than 30 seconds to cool, the operating history may indicate that gas burner assembly 120 is HOT, and a large increase in in air flow relative to the cold start airflow schedule 270 may be used. By contrast, if gas burner assembly 120 had between 30 seconds and ten minutes to cool, the operating history may indicate that gas burner assembly 120 is WARM, and a moderate increase (less than the large increase) in the air flow relative to the cold start airflow schedule 270 may be used. If, however, if the boost mode of gas burner assembly 120 is initiated more than ten minutes after the previous burner shutoff, the operating history may indicate that gas burner assembly 120 is COLD, and the airflow provided from pressurized air source 160 may correspond to the cold start airflow schedule 270.

According to still other embodiments, the same cooling time period 274 may be monitored, and an adjusted airflow schedule may be selected directly from a lookup table based on the measured cooling time period 274. In this regard, controller 220 may know the cold start airflow schedule 270 based on the fuel type selected. Controller 220 may also store data associated with various other airflow schedules that may be selected based directly on the cooling time period 274. Notably, the adjusted airflow schedule 278 may be predetermined based on empirical testing, theoretical models, or in any other suitable manner. In addition, the adjusted airflow schedule 278 may be stored in controller 220 in any suitable manner, such as a data or lookup table.

According to one embodiment, adjusting the airflow schedule may include modifying the cold start airflow schedule 270 by increasing the flow of air relative to the cold start airflow schedule 270 if the operating history indicates that the gas burner assembly was ON within a predetermined time (e.g., on within the last 10 minutes) before opening fuel regulating device 236. Alternatively, determining the adjusted airflow schedule may include obtaining an adjustment factor (e.g., a gain or offset value) from a data table correlating the operating history of the gas burner assembly to such an adjustment factor. The adjusted airflow schedule can then be obtained by modifying the cold start airflow schedule 270 by the adjustment factor, e.g., by multiplying by the gain, by offsetting airflow schedule by the offset values, etc.

According to still another embodiment, the operating history may be defined as a ratio of burner ON time within a predetermined time period. For example, if gas burner assembly 120 was operating for two minutes of the prior four minutes, an operating ratio may be defined as 0.5. Longer operation during those four minutes would result in a higher operating ratio, and vice versa. The adjusted airflow schedule 278 may be increased relative to the cold start airflow schedule 270 if the operating ratio is greater than some predetermined ratio, e.g., 0.5. Thus, controller 220 may monitor operation of fuel regulating device 236 over the prior 2 minutes, 4 minutes, 10 minutes, or any other suitable time period. If gas burner assembly 120 is operating for over half of that time period (or for any other suitable operating ratio of that time period), the adjusted airflow schedule may be increased accordingly. According to still other embodiments, the adjusted airflow schedule may be scaled relative to the cold start airflow schedule 270 based on the operating ratio.

FIG. 11 depicts an exemplary control method having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using gas burner assembly 120 and fuel supply system 230 as an example, it should be appreciated that these methods may be applied to the operation of any suitable gas burner assembly or cooktop appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a gas burner assembly, the gas burner assembly comprising a boost burner, a fuel regulating device for providing a flow of fuel to the boost burner, and an air pump for providing a flow of air to the boost burner, the method comprising:

opening the fuel regulating device to provide the flow of fuel to the boost burner;

obtaining a predetermined cold start airflow schedule;

obtaining an operating history of the gas burner assembly;

determining an adjusted airflow schedule based at least in part on the cold start airflow schedule and the operating history of the gas burner assembly; and operating the air pump to provide the flow of air according to the adjusted airflow schedule.

2. The method of claim 1, wherein the operating history of the gas burner assembly comprises:

a cooling time period measured between opening the fuel regulating device and the last time the fuel regulating device was closed.

3. The method of claim 2, wherein the operating history of the gas burner assembly comprises:

a HOT indication if the cooling time period is less than a first time threshold;

a WARM indication if the cooling time period is greater than the first time threshold but less than a second time threshold; and a COLD indication if the cooling time period is greater than the second time threshold.

4. The method of claim 3, wherein determining the adjusted airflow schedule comprises:

setting the adjusted airflow schedule equal to the cold start airflow schedule if the operating history indicates a COLD gas burner assembly;

modifying the cold start airflow schedule by increasing the flow of air relative to the cold start airflow schedule by a first amount if the operating history provides a WARM indication; and modifying the cold start airflow schedule by increasing the flow of air relative to the cold start airflow schedule by a second amount greater than the first amount if the operating history provides a HOT indication.

5. The method of claim 2, wherein determining the adjusted airflow schedule comprises:

selecting the adjusted airflow schedule from a lookup table based at least in part on the cooling time period.

6. The method of claim 1, wherein determining the adjusted airflow schedule comprises:

modifying the cold start airflow schedule by increasing the flow of air relative to the cold start airflow schedule if the operating history indicates the gas burner assembly was ON within a predetermined time period before opening the fuel regulating device.

7. The method of claim 1, wherein obtaining the operating history is defined as an operating ratio of ON time for the gas burner assembly within a predetermined time period, and wherein determining the adjusted airflow schedule comprises:

increasing the flow of air relative to the cold start airflow schedule if the operating ratio is greater than 0.5; and decreasing the flow of air relative to the cold start airflow schedule if the operating ratio is less than 0.5.

8. The method of claim 1, wherein determining the adjusted airflow schedule comprises:

obtaining an adjustment factor from a data table correlating the operating history of the gas burner assembly to the adjustment factor; and modifying the cold start airflow schedule by the adjustment factor to generate the adjusted airflow schedule.

9. The method of claim 1, wherein determining the adjusted airflow schedule comprises:

approximating a burner temperature of the boost burner based on the operating history; and adjusting the operation of the air pump based on the approximated temperature.

10. The method of claim 1, wherein the cold start airflow schedule is predetermined based on empirical testing.

11. The method of claim 1, wherein the adjusted airflow schedule is predetermined as a function of operating history based on empirical testing.

12. The method of claim 1, wherein obtaining the predetermined cold start airflow schedule comprises:

obtaining a fuel type of the flow of fuel; and selecting the cold start airflow schedule based at least in part on the fuel type.

13. The method of claim 12, wherein selecting the cold start airflow schedule based at least in part on the fuel type comprises:

referencing a data table storing a time-varying airflow curve for each of the fuel types which may be used with the gas burner assembly.

14. The method of claim 1, wherein the gas burner assembly comprises a fuel type switch which specifies the fuel type being used.

15. The method of claim 14, wherein the predetermined cold start airflow schedule is obtained based on a position of the fuel type switch.

16. A gas burner assembly for a cooktop appliance, the gas burner assembly comprising:

a boost burner comprising a plurality of boost flame ports in fluid communication with a boost fuel chamber;

a fuel regulating device fluidly coupled to the boost fuel chamber for providing a flow of fuel to the boost fuel chamber;

an air pump for selectively urging a flow of air into the boost fuel chamber; and a controller operably coupled to the fuel regulating device and the air pump, the controller being configured for:

opening the fuel regulating device to provide the flow of fuel to the boost fuel chamber;

obtaining a predetermined cold start airflow schedule;

obtaining an operating history of the gas burner assembly;

determining an adjusted airflow schedule based at least in part on the cold start airflow schedule and the operating history of the gas burner assembly; and operating the air pump to provide the flow of air according to the adjusted airflow schedule.

17. The gas burner assembly of claim 16, wherein the operating history of the gas burner assembly comprises:

a cooling time period measured between opening the fuel regulating device and the last time the fuel regulating device was closed.

18. The gas burner assembly of claim 16, wherein the operating history of the gas burner assembly comprises:

a HOT indication if the cooling time period is less than a first time threshold;

a WARM indication if the cooling time period is greater than the first time threshold but less than a second time threshold; and a COLD indication if the cooling time period is greater than the second time threshold.

19. The gas burner assembly of claim 18, wherein determining the adjusted airflow schedule comprises:

setting the adjusted airflow schedule equal to the cold start airflow schedule if the operating history indicates a COLD gas burner assembly;

modifying the cold start airflow schedule by increasing the flow of air relative to the cold start airflow schedule by a first amount if the operating history provides a WARM indication; and modifying the cold start airflow schedule by increasing the flow of air relative to the cold start airflow schedule by a second amount greater than the first amount if the operating history provides a HOT indication.

20. The gas burner assembly of claim 16, wherein the gas burner assembly operates on natural gas or propane.

* * * * *